US006785987B2

(12) United States Patent
Bucalo et al.

(10) Patent No.: US 6,785,987 B2
(45) **Date of Patent: *Sep. 7, 2004**

(54) ADJUSTABLE HEEL ASSEMBLY AND SHOE INCLUDING THE SAME

(76) Inventors: Gladys Lopez Bucalo, 3600 Mystic Pointe Dr., #1613, Aventura, FL (US) 33180; Brian D. Bucalo, 3600 Mystic Pointe Dr., #1613, Aventura, FL (US) 33180

( * ) Notice: Subject to any disclaimer, the term of this patent is extended or adjusted under 35 U.S.C. 154(b) by 0 days.

This patent is subject to a terminal disclaimer.

(21) Appl. No.: 10/272,204

(22) Filed: Oct. 16, 2002

(65) Prior Publication Data

US 2003/0106242 A1 Jun. 12, 2003

Related U.S. Application Data

(63) Continuation-in-part of application No. 10/015,397, filed on Dec. 12, 2001, now Pat. No. 6,578,289.

(51) Int. Cl.[7] ..... A43B 3/24
(52) U.S. Cl. ..... 36/100
(58) Field of Search ..... 36/102, 34 R, 36/81, 42

(56) References Cited

U.S. PATENT DOCUMENTS

| | | | | |
|---|---|---|---|---|
| 2,439,310 | A | 4/1948 | Mancuso | 38/42 |
| 3,805,418 | A | 4/1974 | Matuka et al. | 36/34 A |
| 4,416,072 | A | 11/1983 | Sarkissian | 36/100 |
| 4,805,320 | A | 2/1989 | Goldenberg et al. | 36/42 |
| 5,887,360 | A | 3/1999 | Bucalo et al. | 36/100 |
| 6,021,586 | A | 2/2000 | Bucalo et al. | 36/42 |
| 6,578,289 | B1 * | 6/2003 | Bucalo et al. | 36/100 |

* cited by examiner

*Primary Examiner*—M. D. Patterson
(74) *Attorney, Agent, or Firm*—Steinberg & Raskin, P.C.

(57) ABSTRACT

A shoe having an upper, a sole and an adjustable heel assembly including a first heel member connected to the sole at a rear portion thereof and a second heel member arranged at least partially within the first heel member. The second heel member is movable relative to the first member between a first position in which the first and second heel members provide the heel with a first height and a second position in which the first and second heel members provide the heel with a second height greater than the first height. An improved locking mechanism is provided for releasably locking the heel members to each other.

7 Claims, 12 Drawing Sheets

ADJUSTABLE HEEL ASSEMBLY AND SHOE INCLUDING THE SAME

CROSS REFERENCE TO RELATED APPLICATION

This application is a continuation-in-part of U.S. patent application Ser. No. 10/015,397 now U.S. Pat. No. 6,578,289, filed Dec. 12, 2001.

FIELD OF THE INVENTION

The present invention relates to adjustable heel assemblies and shoes having adjustable heel assemblies which enable shoes to be worn at multiple heel heights and, more particularly, to adjustable heel assemblies of the type which include a first heel member having an interior compartment and a second heel member at least partially receivable within the interior compartment for movement between at least first and second positions providing the heel assembly with respective first and second heights.

BACKGROUND OF THE INVENTION

Currently available high-heel shoes for women have a relatively large heel which is fixed to the sole and have a single, predetermined height. This fact has some significant disadvantages for the wearer. In particular, individuals wearing high-heel shoes often experience fatigue or discomfort in their feet because the high heel requires the foot to be bent into an unnatural position. It is also known that prolonged wearing of high-heel shoes can lead to more serious foot problems. Furthermore, some women prefer to wear shoes with relatively low heels at one time of the day, for example, while commuting to work, and then change to shoes with relatively high heels while at work and again back to the shoes with low heels after work.

In order to relieve foot fatigue or discomfort, prevent the development of foot problems or meet personal preferences, a woman is therefore compelled to change from shoes having a relatively high heel to another pair of shoes with a different, lower heel height. It is inconvenient to carry another such pair of shoes and the process of changing shoes is very time consuming.

Applicants have proposed several arrangements of adjustable heel assemblies in their U.S. Pat. Nos. 5,887,360 and 6,021,586, the disclosures of which are incorporated herein by reference, which include first outer heel members having interior compartments and second inner heel members at least partially receivable within the interior compartments for movement between at least first and second positions relative to the first heel member. Various locking mechanisms for releasably locking the heel members to each other when the inner heel member is at either the first or the second position are disclosed which releasably fix the heel assemblies to each other at either the first or the second position to provide the heel assembly with a respective first or second height.

These locking mechanisms are not, however, entirely satisfactory. Several of the illustrated embodiments provide the releasable locking of the inner and outer heel members to each other at only a single point so that during use, a concentrated, asymmetric force is applied to the outer heel member which tends to separate the outer heel member from the sole of the shoe and which tends to twist the inner heel member within the outer heel member.

Other embodiments are inconvenient since they require the user to simultaneously utilize two fingers or pins to apply force in coaxially opposed directions. This action is awkward to do while grasping the heel and moving it between first and second positions.

For example, the embodiment of the locking mechanisms of the adjustable heel shown in FIGS. 1C and 2C of applicants' prior U.S. Pat. No. 6,021,586, utilizes two outwardly biased pins situated in axially aligned diametrically opposed bores in the inner heel member which lock the inner and outer heel members to each other at either the first or the second positions at which corresponding vertically spaced pairs of apertures are formed in the front and rear facing wall sections of the outer heel member, which align with the pins when the heel members are adjusted to one of the first and second positions. While this locking mechanism provides a two-point connection which uniformly distributes the force applied by the inner heel member to the outer heel member and avoids the tendency of the inner heel member to twist within the outer heel member, there are still disadvantages to this locking mechanism. For example, it is necessary to depress both pin members simultaneously to unlock the heel members for adjustment which itself is quite difficult, making it necessary to utilize two fingers to accomplish this simultaneous procedure thereby requiring each shoe to be removed from the foot. Moreover, at least one of the pins extending through at least one of the apertures formed in the wall of the heel member will generally be facing outwardly and be readily visible, along with the other vertically aligned aperture, thereby detracting from the appearance of the heel assembly.

OBJECTS AND SUMMARY OF THE INVENTION

Accordingly, it is an object of the present invention to provide new and improved adjustable heel assemblies and shoes incorporating the same.

Another object of the present invention is to provide new and improved adjustable heel assemblies of the type which include a first heel member having an interior compartment and a second heel member at least partially receivable within the interior compartment for adjustable movement between the two height positions, and shoes incorporating the same.

Still another object of the present invention is to provide a new and improved adjustable heel assembly and shoes incorporating the same, having a new and improved locking mechanism which overcomes the drawbacks of prior locking mechanisms.

A further object of the present invention is to provide a new and improved adjustable heel assembly and shoes incorporating the same, of the type having inner and outer heel members, having a locking mechanism which is easy to use, which provides two points of connection between the inner and outer heel members, does not detract from the appearance of the heel assembly, which provides improved mechanical stability between the inner and outer heel members effectively eliminating any rocking or twisting between the inner and outer heel members and which provides a simultaneous unlocking of the two points of connection with a single hand motion.

Briefly, these and other objects are attained by providing a heel assembly including a first outer heel member having an interior compartment, a second heel member at least partially situated in the compartment so as to be movable between a first position providing the heel assembly with the first height and a second position providing the heel assembly with a second height and a new and improved locking mechanism for locking the inner heel member at the first and second positions. The locking mechanism includes a pair of axially aligned bore regions formed in the inner heel member opening onto diametrically opposed outer surface regions of the inner heel member, upper and lower pairs of axially aligned cavities formed in the outer heel member, and an elongate rod member including first and second pin portions at its end regions. The rod member has a locking position in which the two pin portions are situated in the respective bore regions formed in the inner heel member and, depending upon which position the inner heel member is in, either the upper or the lower pair of cavities formed in the outer heel member. The rod member is movable to an unlocked position in which one pin portion is removed from its respective bore region in the inner heel member and the second pin portion is situated entirely within the other bore region of the inner heel member. A slot formed in the wall of the outer heel member between two of the vertically spaced cavities is receivable of the portion of the rod member between the pin portions and permits movement of the inner heel member between the first and second positions with the locking pin in its unlocked position. Biasing means in the form of a spring bias the rod member towards the locked position, and grasping means are provided at one end of the rod member to enable the rod member to be grasped and pulled in an axial direction from the locked position to the unlocked position against the biasing force of the spring. This new locking mechanism provides a secure two point connection of the inner and outer heel members to each other and can be unlocked with a single hand by the wearer grasping and pulling on the elongate rod member to move it from the locked to the unlocked position.

The adjustable heel assemblies according to a second embodiment of the present invention includes a pin which has as its first pin portion shaped like a rectangular bar.

BRIEF DESCRIPTION OF THE DRAWINGS

A more complete appreciation of the present invention and many of the attendant advantages thereof will be readily understood by reference to the following detailed description when considered in connection with the accompanying drawings, in which.

DETAILED DESCRIPTION OF THE PREFERRED EMBODIMENT

Figure 1A:
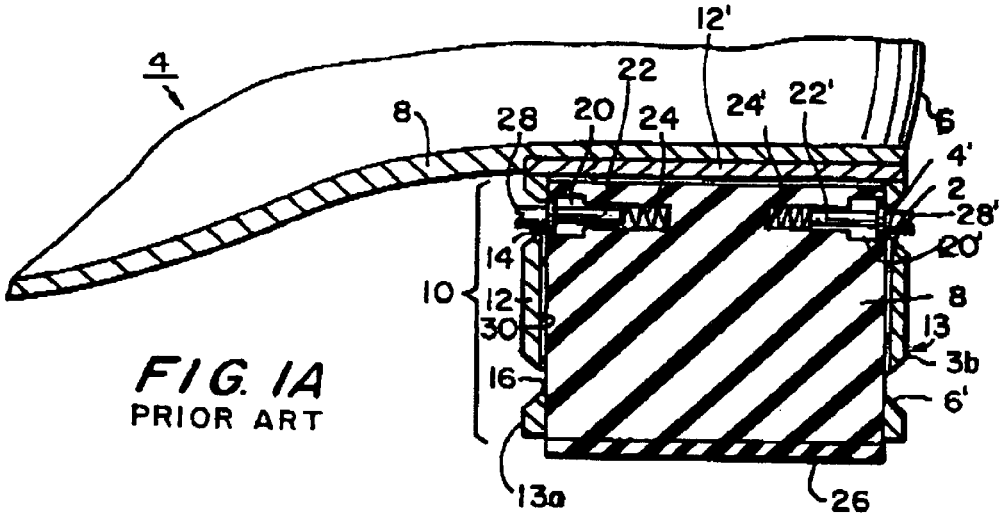
FIG. 1A PRIOR ART
FIGS. 1A and 1B are side elevation views in section showing a prior art adjustable heel assembly in which an inner heel member is shown in a first position in FIG. 1A and in a second position in FIG. 1B.
Figure 1B:
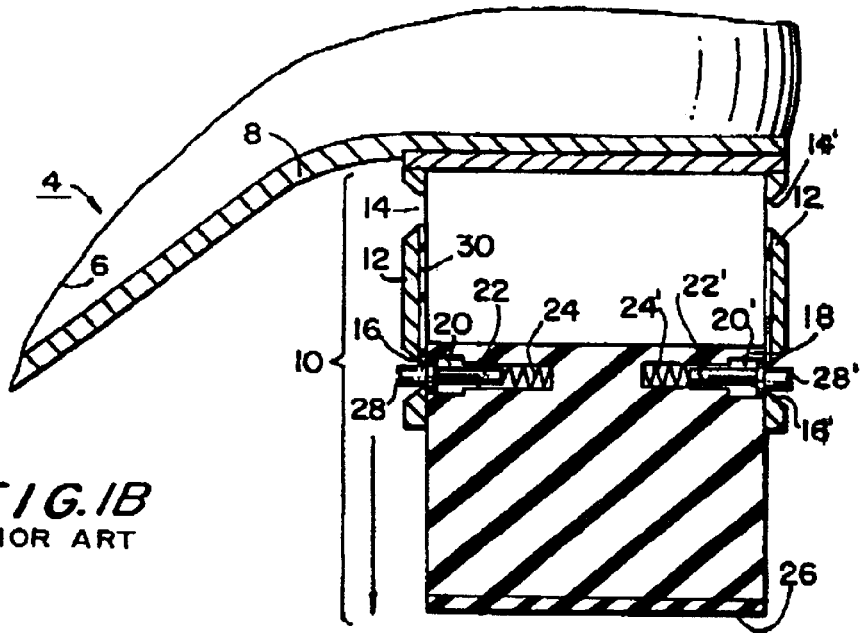
FIG. 1B PRIOR ART

Referring now to the drawings wherein like reference characters designate identical or corresponding parts throughout the several views and more particularly to FIGS. 1A and 1B, a shoe 4 incorporating an adjustable heel assembly 10 according to the prior art is illustrated. The shoe comprises an upper 6 and a flexible sole 8 made from typical materials therefor, e.g., a stiff but somewhat flexible material, whereby the upper 6 is arranged in connection with and above the sole 8. The stiffness and flexibility of the sole 8 may vary along different points of its length. The shoe 4 also includes an adjustable heel assembly 10 in accordance with the prior art which comprises a downwardly oriented outer heel casing 12 defined by a wall 13 having a forward facing wall section 13*a*, a rearward facing wall section 13*b*, side facing wall sections and a roof section 12' cooperating to provide the desired shape of the heel and which is mounted to the downwardly facing surface of the sole 8. The roof section 12' of the outer heel casing 12 is operatively connected to downward facing surface of sole 8. This connection may be in the form of nails, screws and/or adhesive.

The heel assembly 10 also includes a movable inner heel block 18 positionable at least partially within an interior compartment of the outer heel casing 12 as shown in FIGS. 1A and 1B. Inner heel block 18 is defined by a body having outer surfaces providing a suitable shape for the heel. A portion of the inner heel block 18 extends through the open lower end of the outer heel casing 12.

A rubber heel 26 is arranged on the lower surface of inner heel block 18 and constitutes the lowermost surface of the heel assembly 10 which contacts the ground regardless of the position of the inner heel block 18 relative to the outer heel casing 12.

The inner heel block 18 is movable within the interior compartment of outer heel casing 12 between a first raised position shown in FIG. 1A which provides the heel assembly with a first decreased height and a second lowered position shown in FIG. 1B which provides the heel assembly with a second increased height.

A locking mechanism is provided for selectively releasably locking the inner heel block 12 to the outer heel casing in the first and second positions. The locking mechanism comprises first and second pins 22, 22' situated in axially aligned, diametrically opposed first and second bores 20, 20' formed in the inner heel block 18. Upper and lower pairs of axially aligned apertures 14, 14' and 16, 16' are formed through the forwardly and rearwardly facing wall sections 13*a*, 13*b*. When the inner heel block 18 is in the first raised position shown in FIG. 1A, the first and second pins, 22, 22' are urged under the biasing force of first and second springs 24, 24' to extend outwardly from holes 20, 20' through the upper first and second apertures 14, 14' thereby locking the inner heel block 18 and the outer heel casing 12 to each other, providing the heel assembly 10 with a decreased height.

In order to adjust the height of heel assembly 10, both first and second pins 22, 22' are simultaneously pushed inwardly against the force of springs 24, 24' until both completely clear the thickness of wall sections 13*a*, 13*b*. The pins 22, 22' are simultaneously pushed inwardly by pushing on the heads 28, 28' of pins 22, 22', either through the use of two pointed objects, such as a pen or a pencil, or with two finger tips. The inner heel block 18 is then grasped and pulled outwardly from the interior compartment of outer heel casing 12 with the pins being held within holes 20, 20' against the force of springs 24, 24' by the inner surfaces of wall sections 13*a*, 13*b*. When the inner heel block 18 reaches the second position shown in FIG. 1B, the first and second pins 22, 22' become aligned with the lower first and second apertures 16, 16' and snap outwardly under the force of springs 24, 24' so that they extend from bores 20, 20' through the lower first and second apertures 16, 16' thereby locking the inner heel block 18 and the outer heel casing 12 to each other with the inner heel block 18 in its second lowered position, thereby providing the heel assembly 10 with an increased height. To readjust the height of the heel assembly, the pins 20, 20' are pushed simultaneously inwardly again to unlock the inner heel block from the outer heel casing and then moving the inner heel block back to the first position.

The prior art locking mechanism is not entirely satisfactory for the reasons noted above. It is necessary to utilize two separate pointed objects to unlock the inner heel block 18 from the outer heel casing 12. It is quite difficult to use two finger tips to simultaneously push the two pins 20, 20' through the small diameter apertures 14, 14'; 16, 16' in the outer heel casing. Moreover, the visibility of the upper and lower second apertures 14', 16' and the head 28' of the second pin 20' extending through one of the apertures at the rearwardly facing wall section 13*b*, detracts from the appearance of the heel assembly.

Figure 2:
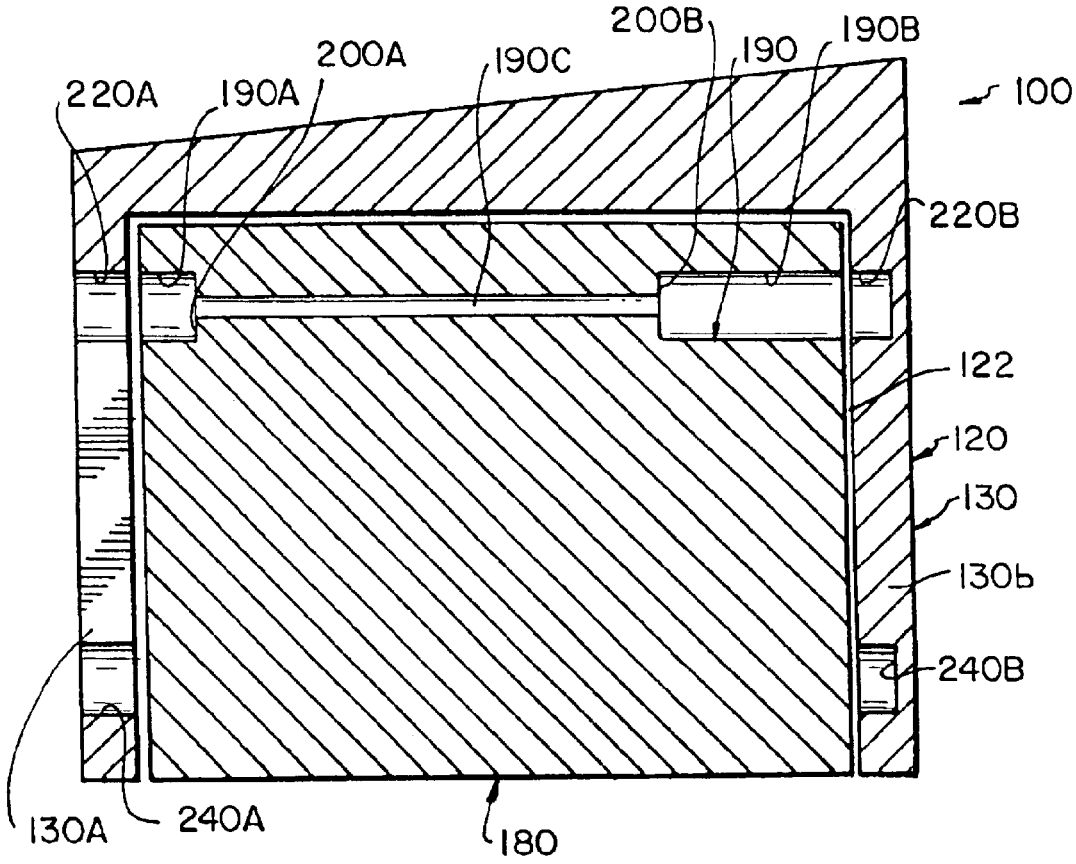
FIG. 2 is a side elevation view in section of a heel assembly in accordance with a preferred embodiment of the present invention with the elongate rod member omitted for purposes of clarity.
Figure 3:
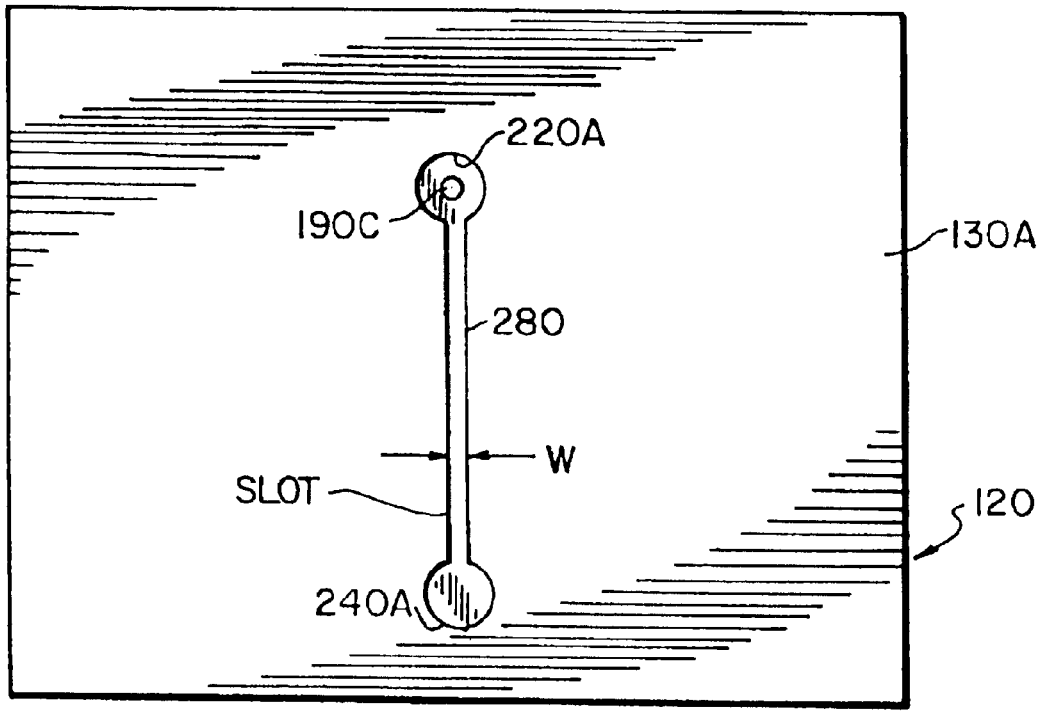
FIG. 3 is a front elevation view in section of the heel assembly shown in FIG. 2.
Figure 4A:
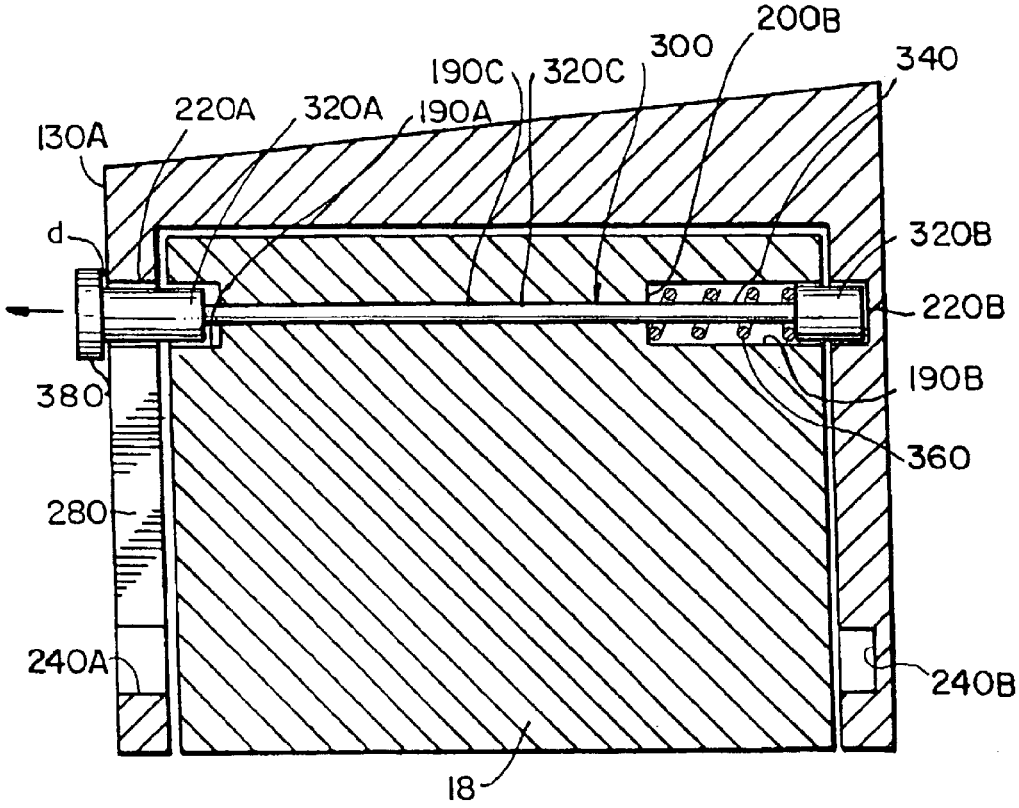
FIG. 4A is a side elevation view in section of the embodiment of the heel assembly shown in FIG. 2 showing the elongate rod member in its locked position with the inner heel member in a first position.
Figure 4B:
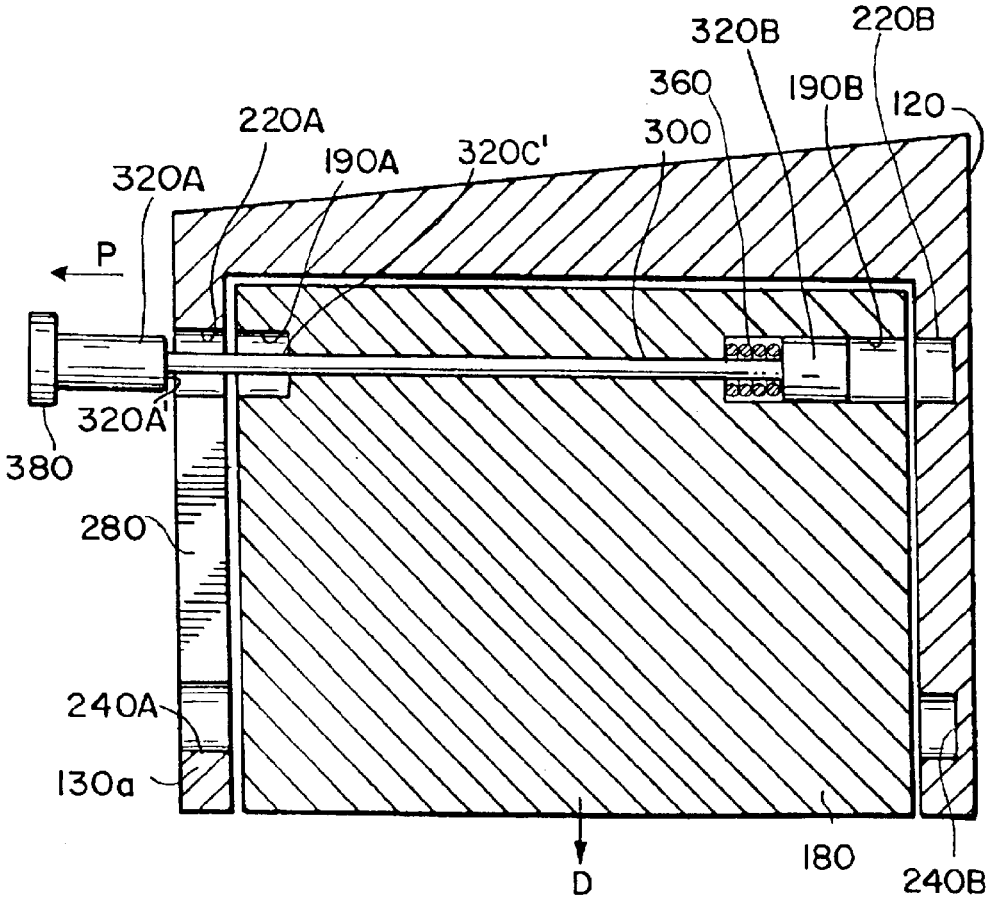
FIG. 4B is a side elevation view in section of the embodiment of the heel assembly shown in FIG. 2 showing the rectangular elongate rod member in its unlocked position and with the inner heel member still in the first position.
Figure 4C:
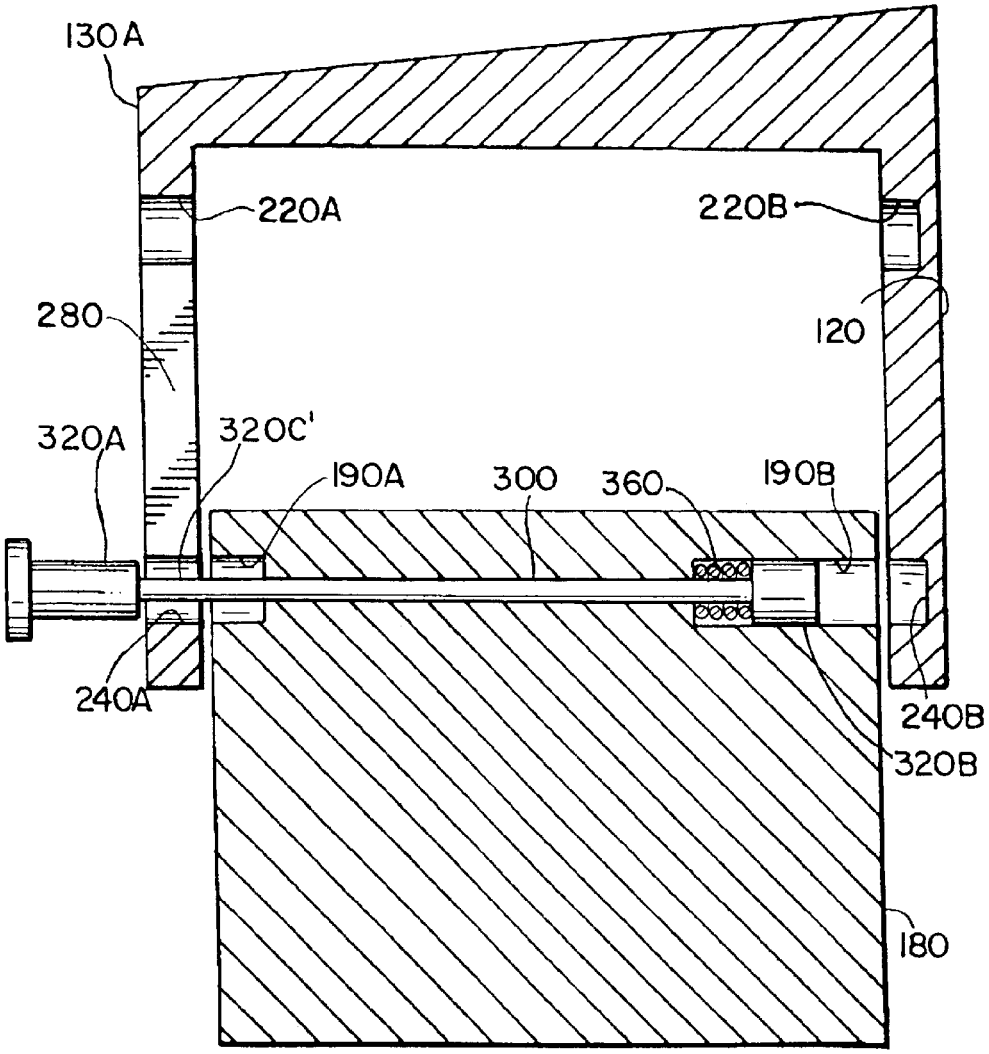
FIG. 4C is a side elevation view in section of the embodiment of the heel assembly shown in FIG. 2 showing the elongate rod member in its unlocked position with the inner heel member in a second position.

Referring now to FIGS. 2–4, an improved adjustable heel assembly in accordance with the invention, generally designated 100, comprises a first outer heel casing 120 having an interior compartment 122 within which a second inner heel block 180 having a solid body is at least partially situated so as to be slidingly movable between a first position shown in FIG. 4A and a second position shown in FIG. 4C in order to provide the heel assembly with a first reduced height and a second increased height respectively. The outer heel casing 120 is defined in part by a wall 130 having a forward facing wall section 130A, a rearward facing wall section 130B, and side facing wall sections.

In accordance with the invention, a locking mechanism is provided for selectively releasably locking the inner heel block 180 within the outer heel casing 120 at the first and second positions. The locking mechanism comprises a bore 190 formed diametrically through an upper portion of the inner heel block 180, opening at diametrically opposed outer surface regions of the inner block 180. The two end regions of bore 190 comprise bore regions 190A and 190B having enlarged diameters relative to a reduced diameter interconnecting bore region 190C, thereby forming seating surfaces 200A, 200B at the inner ends of bore regions 190A, 190B. It is understood that the inner heel block need not necessarily comprise a solid body and that the bore regions can be formed by other structures, so long as there is an open space between the bore regions for reasons which will become clear below.

Upper and lower pairs of axially aligned first and second cavities 220A, 220B; 240A, 240B are formed in the outer heel casing 120. Each of the first cavities 220A, 240A comprise apertures formed through the forwardly facing wall section 130A of outer heel casing 120. While each of the second cavities 220B, 240B preferably comprise recesses formed in the inner surface of the rearwardly facing wall section 130B only partly through the thickness of the wall section 130B as shown, it is possible to form the second cavities 220B, 240B in the form of apertures which extend through the entire thickness of the wall section. When the inner heel block 180 is situated in its first position as seen in FIG. 4A, the bore 190 is axially aligned with the upper pair of first and second cavities, 220A, 220B. When the inner heel block 180 is situated in its second position, the bore 190 is aligned with the lower pair of first and second cavities 240A, 240B. The diameter of the upper and lower first cavities, 220A, 240A is about the same as the diameter of the first bore region 190A, while the diameter of the upper and lower second cavities, 220B, 240B is about the same as the diameter of the second bore region 190B.

Referring to FIG. 3, a thin slot 280 extends between and opens into the first upper and lower cavities 220A and 240A, in the forwardly facing wall section 130A of the outer heel casing 120 for purposes which will become clear below.

Referring to FIGS. 4A–4D, and more particularly to FIG. 4A, an elongate rod member 300 is slidably situated in bore 190 and comprises first and second pin portions 320A, 320B at its ends and a reduced diameter interconnecting rod portion 320C. As seen in FIG. 4A, the rod member 300 is sized and positioned such that when the inner heel block 180 is in its first position and the rod member is positioned so that it extends to the maximum extent possible into the second upper cavity 220B (to the right in FIG. 4A), the first pin portion 320A is positioned in both the first bore region 190A and the aligned first upper cavity 220A, the second pin portion 320B is positioned in both the second bore region 190B and the aligned second upper cavity 220B and the reduced diameter rod portion 320C extends through interconnecting bore region 190C. The second pin portion 320B and second bore region 190B are sized so that in this position, a cylindrical space 340 is defined between the seat 200B at the inner end of the second bore region 190B and the inner end surface of the pin portion 320B. A compressed spring 360 is situated in the space 340 having its ends bearing against the seat 200B and the inner end surface of second pin portion 320B, thereby normally urging the rod member 300 to the position shown in FIG. 4A. The rod member 300 is provided with an enlarged head 380 on the outer end of the first pin portion 320A. The head 380 is spaced a small distance d from the outer surface of wall section 130A when the rod member 300 is in the position shown in FIG. 4A.

When rod member 300 is in the position shown in FIG. 4A, the inner heel block 180 is prevented from movement from its first raised position (FIG. 4A) by virtue of the pin portion 320A being positioned in both the inner heel block bore region 190A and the aligned outer heel casing cavity 220A, and by virtue of the pin portion 320B being positioned in both the inner heel block bore region 190B and the aligned outer heel casing cavity 220B. This two-point locking connection more uniformly distributes forces from the inner heel block to the outer heel casing and eliminates the tendency of the inner heel block to twist during normal walking.

Referring to FIG. 3 in conjunction with FIG. 4B, it is noted that when the rod member is pulled to the position shown in FIG. 4B, the first pin portion 320A not only is withdrawn from the first inner bore region 190A, but also clears the first upper cavity 220A so that the adjacent end region 320C' of the interconnecting rod portion 320C is situated above the vertical slot 280 formed in the forwardly facing wall section 130A of outer heel casing 120 between the upper and lower first cavities 220A, 240A. The width w (FIG. 3) of slot 280 is greater than the diameter of the end region 320C' of the interconnecting rod portion 320C. It will therefore be seen that when the elongate rod member 300 has been pulled to the position shown in FIG. 4B, i.e. the unlocking position, the inner heel block 180 is completely unlocked from the outer heel casing 120.

With the elongate rod member 300 in its unlocked position shown in FIG. 4B, the inner heel block 180 is grasped and pulled in the direction designated D whereupon the inner heel block 180 is moved downwardly, with end region 320C' of the interconnecting rod portion 320C sliding through slot 280, until in reaches the second position shown in FIG. 4C. It is noted that it is not necessary for the user to continue to pull on the rod member 300 during movement of the inner heel block from the first to the second position since the inner end surface 320A' (FIG. 4B) of the first pin portion 320A will engage the regions of the outer surface of wall section 130A adjacent to the slot 280 under the force of spring 360, thereby maintaining the rod member 300 in its unlocked position as the inner heel block is moved to the second lower position.

Figure 4D:
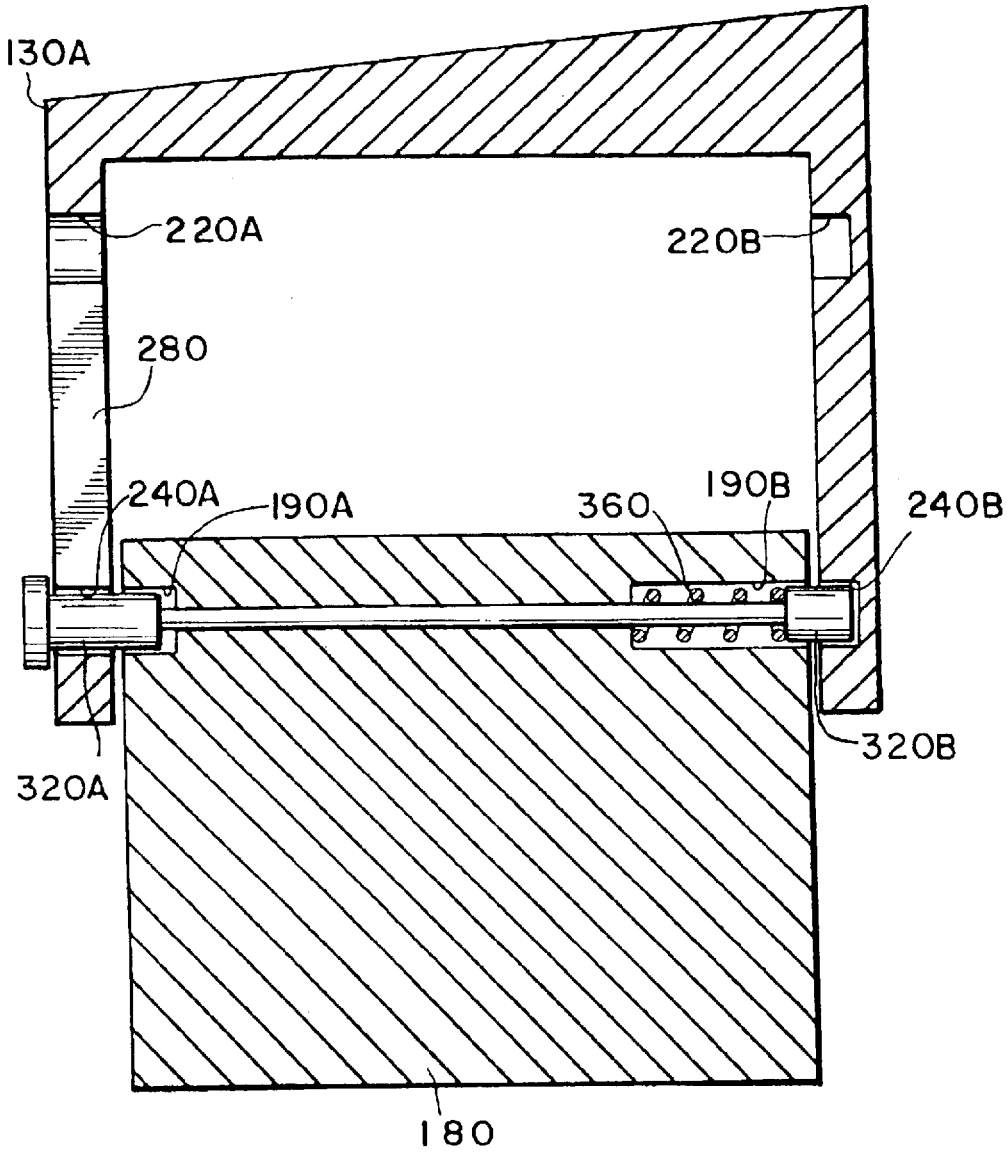
FIG. 4D is a side elevation view in section of the embodiment of the-heel assembly shown in FIG. 2 showing the elongate rod member in its locked position with the inner heel member in the second position.

Referring to FIGS. 4C and 4D, when the inner heel block 180 reaches it second position in the compartment of the outer heel casing 120, the first and second bore portions 190A, 190B align with the first and second lower cavities 240A, 240B of outer heel casing 120. The end region 320C' of the interconnecting pin portion 320 of pin member 300 has left slot 280 and is situated in the first lower cavity 240A. The pin portion 320A is aligned with the aligned cavity 240A and first bore region 190A and the pin portion 320B situated in the second bore region 190B is aligned with the aligned cavity 240B. When the inner heel block has reached this position, the rod member 300 will snap into its locking position shown in FIG. 4D under the force of spring 360, whereupon the first pin portion 320A becomes situated in the aligned first lower cavity and first bore region 240A, 190A, and the second pin portion 320B becomes situated in the aligned second lower cavity and second bore region 240B, 190B, thereby locking the inner heel block 180 to the outer heel casing 120. It is readily seen that unlocking the inner heel member 180 from the outer heel casing 120 and moving it to its first position requires essentially the same procedure including pulling on the rod member to move it to its unlocked position and then sliding the inner heel block upwardly into the outer heel casing.

Figure 5:
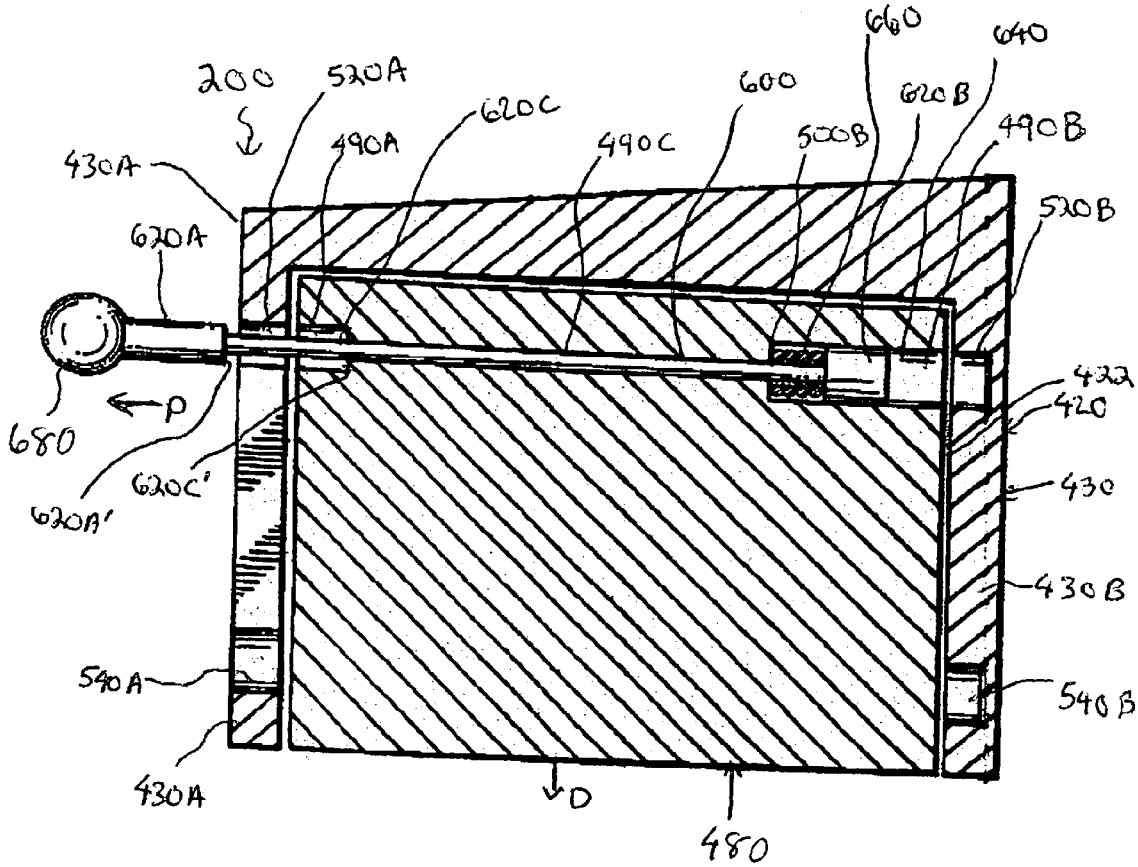
FIG. 5 is a side elevation view in section of the heel assembly showing the rectangular elongate rod member in its unlocked position and with the inner heel member still in the first position according to another embodiment of the invention.
Figure 6:
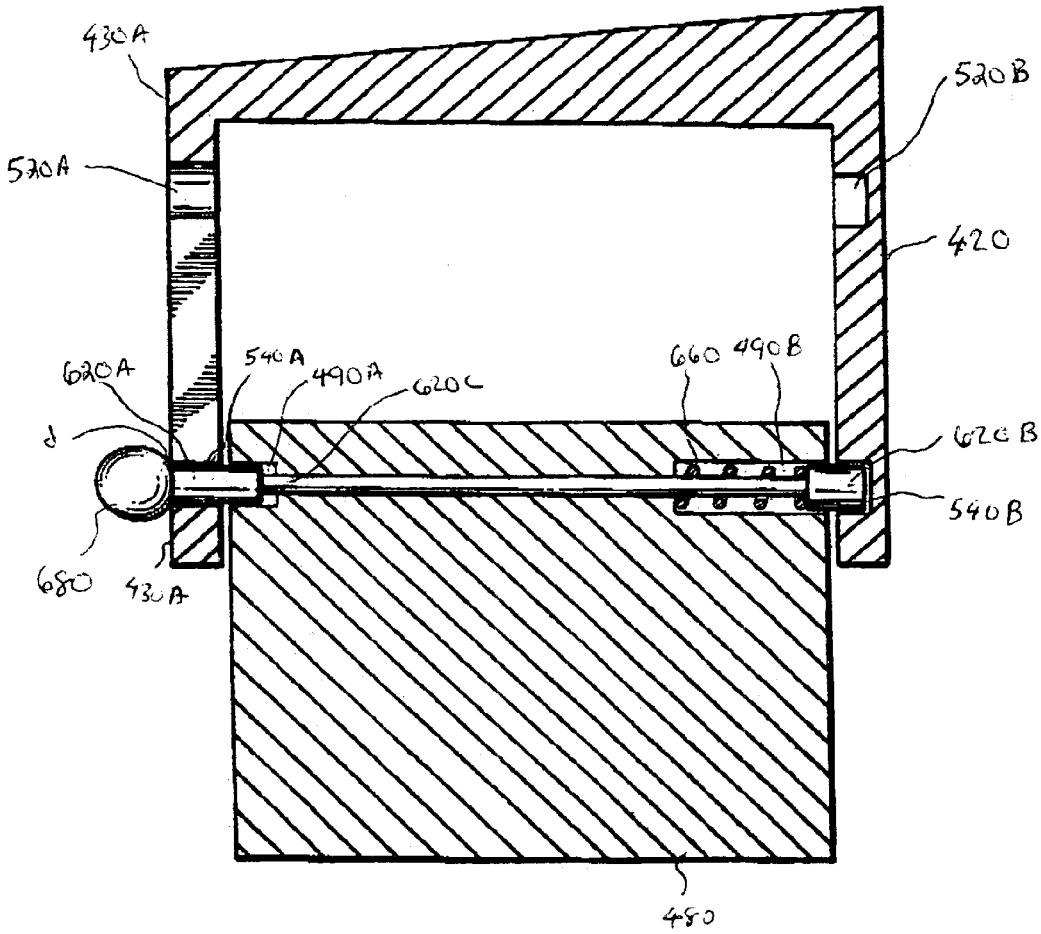
FIG. 6 is a side elevation view in section of the heel assembly showing the rectangular elongate rod member in its locked position with the inner heel member in the second position according to another embodiment of the invention.

Referring now to FIGS. 5–9, an improved adjustable heel assembly in accordance with another embodiment of the invention, generally designated 200, comprises a first outer heel casing 420 having an interior compartment 422 within which a second inner heel block 480 having a solid body is at least partially situated so as to be slidingly movable between a first position shown in FIG. 5 and a second position shown in FIG. 6 in order to provide the heel assembly with a first reduced height and a second increased height respectively. The outer heel casing 420 is defined in part by a wall 430 having a forward facing wall section 430A, a rearward facing wall section 430B, and side facing wall sections.

Referring to FIGS. 5–6, and more particularly to FIG. 5, a elongate rod member 600 is slidably situated in bore 490 and comprises first and second pin portions 620A, 620B at its ends and a reduced diameter interconnecting rod portion 620C. As seen in FIG. 5, the rod member 600 is sized and positioned such that when the inner heel block 480 is in its first position and the rod member is positioned so that it extends to the maximum extent possible into a second upper cavity 520B (to the right in FIG. 5), the first pin portion 620A is positioned in both a first bore region 490A and an aligned first upper cavity 520A, the second pin portion 620B is positioned in both the second bore region 490B and the aligned second upper cavity 520B and the reduced diameter rod portion 620C extends through interconnecting bore region 490C. The second pin portion 620B and second bore region 490B are sized so that in this position, a cylindrical space 640 is defined between a seat 500B at the inner end of the second bore region 490B and the inner end surface of the pin portion 620B. A compressed spring 660 is situated in the space 640 having its ends bearing against the seat 500B and the inner end surface of second pin portion 620B. The rod member 600 is provided with an enlarged head 680 on the outer end of the first pin portion 620A. The head 680 is spaced a small distance d from the outer surface of wall section 430A when the rod member 600 is in the position shown in FIG. 6.

Referring to FIGS. 5 and 6, if it is desired to adjust the height of the heel assembly to an increased height, i.e. to the increased height shown in FIG. 6, in which the inner heel block is located in its second position, the user grasps the head 680 of the rod member 600 and pulls the rod member in the direction designated P to the position shown in FIG. 5 against the force of the spring 660. It is noted that in the position shown in FIG. 5, the second pin portion 620B has been retracted entirely from the upper second cavity 520B in outer heel casing 420 and becomes situated entirely within the second bore region 490B, while the first pin portion 620A has been retracted entirely from the first bore region 490A in the inner heel block 480, so that the pin portions no longer prevent sliding movement of the inner heel block within the outer heel casing.

Figure 7:
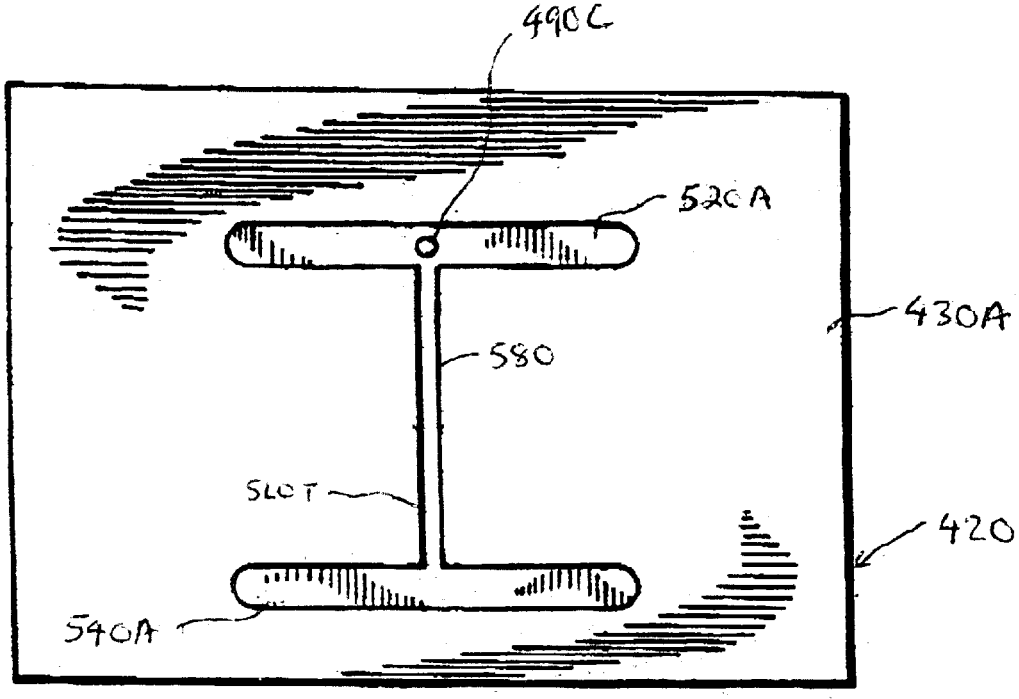
FIG. 7 is a front elevation view in section of the heel assembly shown in FIG. 5.

Referring to FIG. 7, a thin slot 580 extends between and opens into the first upper and lower cavities 520A and 540A, in: the forwardly facing wall section 430A of the outer heel casing 420 for purposes which will become clear below.

Referring to FIG. 7 in conjunction with FIG. 5, it is noted that when the rod member is pulled to the position shown in FIG. 5, the first pin portion 620A not only is withdrawn from the first inner bore region 4.90A, but also clears the first upper cavity 520A so that an adjacent end region 620C' of the interconnecting rod portion 620C is situated above the vertical slot 580 formed in the forwardly facing wall section 430A of outer heel casing 420 between the upper and lower first cavities 520A, 540A.

With the elongate rod member 600 in its unlocked position shown in FIG. 5, the inner heel block 480 is grasped and pulled in the direction designated D whereupon the inner heel block 480 is moved downwardly, with end region 620C' of the interconnecting rod portion 620C sliding through slot 680, until in reaches the second position shown in FIG. 6. It is noted that it is not necessary for the user to continue to pull on the rod member 600 during movement of the inner heel block from the first to the second position since the inner end surface 620A' (FIG. 5) of the first pin portion 620A will engage the regions of the outer surface of wall section 430A adjacent to the slot 580 under the force of spring 660, thereby maintaining the rod member 600 in its unlocked position as the inner heel block is moved to the second lower position.

Referring to FIG. 6, the heel assembly is shown in the locked position. When the inner heel block 480 reaches it second position in the compartment of the outer heel casing 420, the first and second bore portions 490A, 490B align with the first and second lower cavities 540A, 540B of outer heel casing 420. When the inner heel block has reached this position, the rod member 600 will snap into its locking position shown in FIG. 6 under the force of spring 660, whereupon the first pin portion 620A becomes situated in the aligned first lower cavity and first bore region 540A, 490A, and the second pin portion 620B becomes situated in the aligned second lower cavity and second bore region 540B, 490B, thereby locking the inner heel block 480 to the outer heel casing 420. It is readily seen that unlocking the inner heel member 480 from the outer heel casing 420 and moving it to its first position requires essentially the same procedure including pulling on the rod member to move it to its unlocked position and then sliding the inner heel block upwardly into the outer heel casing.

Figure 8:
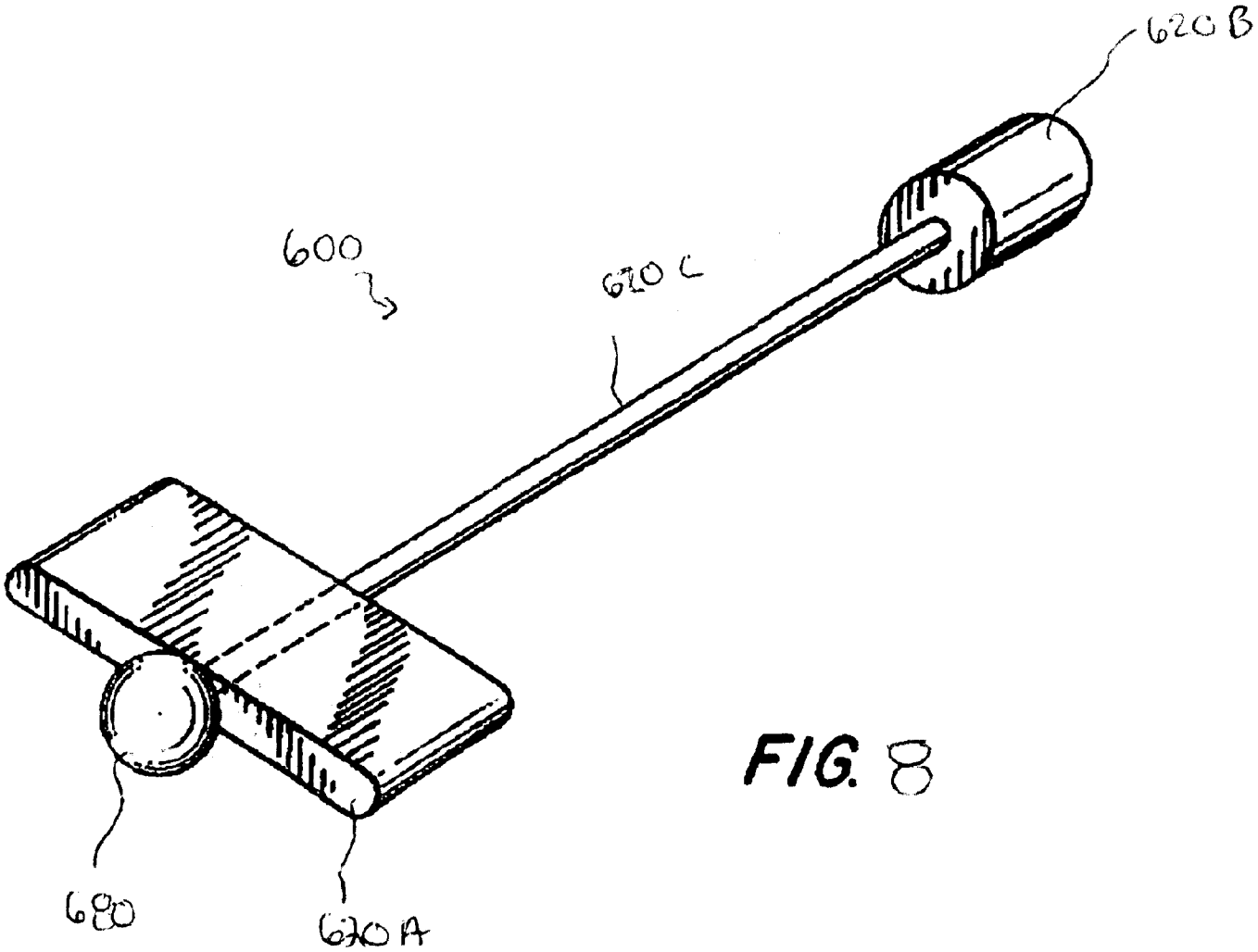
FIG. 8 is a perspective view of the elongate rod member of the heel assembly shown in FIG. 5.
Figure 9:
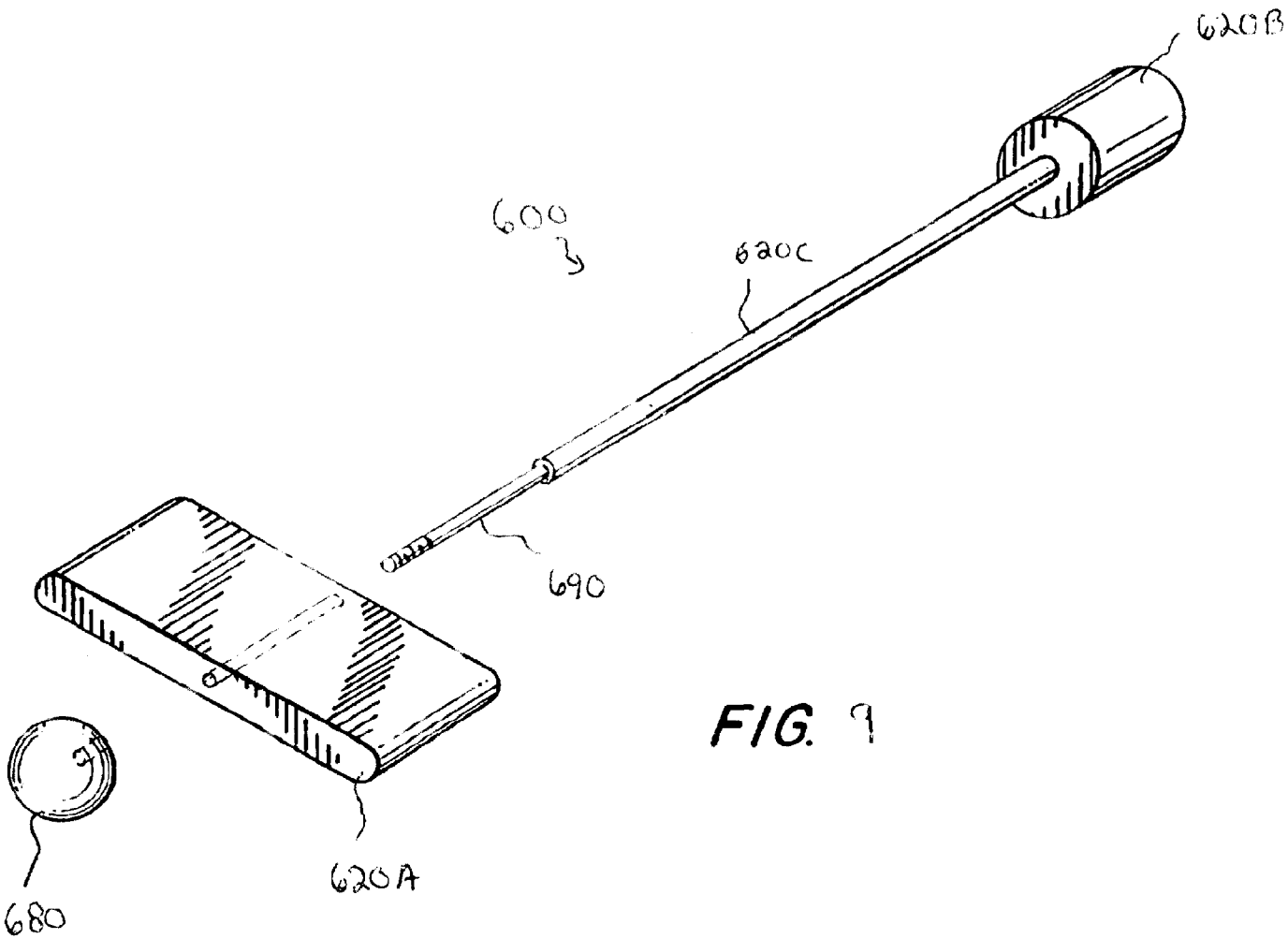
FIG. 9 is an exploded view of the elongate rod member of the heel assembly shown in FIG. 5.

Referring to FIGS. 8 and 9, the first portion 620A of the elongate rod member 600 is a rectangular substantially flat plate which inserts in to the first lower cavity 540A and the first upper cavity 520A. Additionally, in this embodiment the first lower cavity 520A and the second lower cavity 540A are structured, arranged and dimensioned to receive the rectangular substantially flat plate that is the first portion 620A of the elongate rod 600. The reduced diameter interconnecting rod portion 620C has a further reduced diameter portion 690 that has a smaller diameter than the reduced diameter interconnecting rod portion 620C. The further reduced diameter portion 690 extends through the first portion 620A and is adapted to connect to the enlarged head 680 of the elongate rod 600.

The locking mechanism of the heel assembly according to the invention is advantageous in that a two-point connection of the inner heel block and the outer heel casing is achieved while making it quite simple for a person to unlock the inner and outer heel members. It is only necessary for the user to pull on the single rod member which can be accomplished with one hand without taking the shoe off the foot. Although not required in all embodiments of the invention, the upper and lower second cavities 220B, 240B may comprise recesses rather than through-apertures, so that these can be formed in the inner surfaces of visible wall sections of the outer heel casing without themselves being visible and therefore without detracting from the appearance of the heel assembly. While the heel assembly may be formed of conventional material, such as wood or a strong nylon, such as Delrin or polycarbonate, such as Lexan, those regions which are subjected to substantial forces during use may be formed by, or reinforced with, metallic material.

The embodiment with the rectangular insert as the first portion of the elongate member provides added strength and durability to the improved heel assembly. The rectangular insert provides additional stability to the heel assembly by providing a more stable plane for the inner heel block thereby reducing relative tilting and twisting movement of the inner heel block and the outer heel casing and vibration of the inner heel block.

In addition, the rectangular insert may be colored on one or more of its surfaces with a highly visible color, such as red. When the rectangular insert is completely seated in the locked position the red color would not be visible to the user. If the rectangular insert is not seated in a locked position the colored surface would be visible, thereby serving as a visual signal that the heel members were not properly locked together.

Obviously, numerous modifications and variations of the present invention are possible in the light of the above teachings. For example, rails can be formed on the inner surface of the outer heel casing and/or the outer surface of the inner heel block to facilitate the sliding movement of the heel block in the heel casing and the inner heel block and outer heel casing may have any suitable cross-sectional shape including rectangular, circular and variations thereof. It is therefore to be understood that within the scope of the claims appended hereto, the invention may be practiced otherwise than as specifically disclosed herein.

We claim:

1. A heel assembly for a shoe, comprising:

a first outer heel member having an interior compartment defined in part by a wall;

a second inner heel member at least partially situated in said interior compartment, said second heel member being movable between a first position in said compartment providing said heel assembly with a first height and a second position in said compartment providing said heel assembly with a second height;

a locking mechanism for selectively releasably locking said inner heel member at said first and second positions, including a pair of axially aligned first and second bore regions formed in said inner heel member opening onto diametrically opposed outer surface regions thereof;

upper and lower pairs of axially aligned first and second cavities formed in said outer heel member, each of said first cavities comprising first apertures formed through said wall of said outer heel member situated at a first wall region thereof; and each of said second cavities situated at a second wall region diametrically opposite from a respective one of said first cavities;

an elongate rod member including first and second pin portions at its end regions, said rod member having a locking position in which said first pin portion is situated in said first bore region of said inner heel member and one of said upper and lower first cavities formed in said outer heel member, said second pin portion situated in said second bore region of said inner heel member and the one of said upper and lower second cavities formed in said outer heel member to lock said inner heel member to said outer heel member in one of said first and second positions;

said rod member having an unlocked position with said first pin portion situated outside of said first bore region of said inner heel member and said second pin portion situated within said second bore region of said inner heel member and outside of both said upper and lower second cavities and wherein said first pin portion comprises a substantially flat plate member;

biasing means for applying a biasing force on said rod member toward said locking position;

means for grasping said rod member for pulling the same in an axial direction from said locked position to said unlocked position against the biasing force of said biasing means; and a slot formed through said outer heel member wall extending between and opening into said upper and lower first apertures to receive a section of said rod member to permit movement of said inner heel member between said first and second positions when said rod member is said unlocked position.

2. A heel assembly for a shoe, comprising:

a first outer heel member having an interior compartment defined in part by a wall;

a second inner heel member at least partially situated in said interior compartment, said second heel member being movable between a first position in said compartment providing said heel assembly with a first height and a second position in said compartment providing said heel assembly with a second height;

a locking mechanism for selectively releasably locking said inner heel member at said first and second positions, including a pair of axially aligned first and second bore regions formed in said inner heel member opening onto diametrically opposed outer surface regions thereof;

upper and lower pairs of axially aligned first and second cavities formed in said outer heel member, each of said first cavities comprising first apertures formed through said wall of said outer heel member situated at a first wall region thereof; and each of said second cavities situated at a second wall region diametrically opposite from a respective one of said first cavities;

an elongate rod member including first and second pin portions at its end regions, said rod member having a locking position in which said first pin portion is situated in said first bore region of said inner heel member and one of said upper and lower first cavities formed in said outer heel member, said second pin portion situated in said second bore region of said inner heel member and the one of said upper and lower second cavities formed in said outer heel member to lock said inner heel member to said outer heel member in one of said first and second positions;

said rod member having an unlocked position with said first pin portion situated outside of said first bore region of said inner heel member and said second pin portion situated within said second bore region of said inner heel member and outside of both said upper and lower second cavities and wherein said first upper and lower cavities are structured and arranged to receive said plate member;

biasing means for applying a biasing force on said rod member toward said locking position;

means for grasping said rod member for pulling the same in an axial direction from said locked position to said unlocked position against the biasing force of said biasing means; and a slot formed through said outer heel member wall extending between and opening into said upper and lower first apertures to receive a section of said rod member to permit movement of said inner heel member between said first and second positions when said rod member is said unlocked position.

3. A heel assembly for a shoe, comprising:

a first outer heel member having an interior compartment defined in part by a wall;

a second inner heel member at least partially situated in said interior compartment, said second heel member being movable between a first position in said compartment providing said heel assembly with a first height and a second position in said compartment providing said heel assembly with a second height;

a locking mechanism for selectively releasably locking said inner heel member at said first and second positions, including a pair of axially aligned first and second bore regions formed in said inner heel member opening onto diametrically opposed outer surface regions thereof;

upper and lower pairs of axially aligned first and second cavities formed in said outer heel member, each of said first cavities comprising first apertures formed through said wall of said outer heel member situated at a first wall region thereof; and each of said second cavities situated at a second wall region diametrically opposite from a respective one of said first cavities;

an elongate rod member including first and second pin portions at its end regions, said rod member having a locking position in which said first pin portion is situated in said first bore region of said inner heel member and one of said upper and lower first cavities formed in said outer heel member, said second pin portion situated in said second bore region of said inner heel member and the one of said upper and lower second cavities formed in said outer heel member to lock said inner heel member to said outer heel member in one of said first and second positions;

said rod member having an unlocked position with said first pin portion situated outside of said first bore region of said inner heel member and said second pin portion situated within said second bore region of said inner heel member and outside of both said upper and lower second cavities;

biasing means for applying a biasing force on said rod member toward said locking position;

means for grasping said rod member for pulling the same in an axial direction from said locked position to said unlocked position against the biasing force of said biasing means; and a slot formed through said outer heel member wall extending between and opening into said upper and lower first apertures to receive a section of said rod member to permit movement of said inner heel member between said first and second positions when said rod member is said unlocked position wherein said elongate rod member has a first section and a second section, said second section having a smaller diameter than said first section.

4. A heel assembly as recited in claim 3 wherein said second section of said elongate rod member is structured and arranged to pass through a bore in said first pin portion and said second section has a terminal end portion adapted to be coupled to said means for grasping said rod member.

5. A heel assembly for a shoe, comprising:

a first outer heel member having an interior compartment defined in part by a wall;

a second inner heel member at least partially situated in said interior compartment, said second heel member being movable between a first position in said compartment providing said heel assembly with a first height and a second position in said compartment providing said heel assembly with a second height;

a locking mechanism for selectively releasably locking said inner heel member at said first and second positions, including a pair of axially aligned first and second bore regions formed in said inner heel member opening onto diametrically opposed outer surface regions thereof;

upper and lower pairs of axially aligned first and second cavities formed in said outer heel member, each of said first cavities comprising first apertures formed through said wall of said outer heel member situated at a first wall region thereof; and each of said second cavities situated at a second wall region diametrically opposite from a respective one of said first cavities;

an elongate rod member including first and second pin portions at its end regions, said rod member having a locking position in which said first pin portion is situated in said first bore region of said inner heel member and one of said upper and lower first cavities formed in said outer heel member, said second pin portion situated in said second bore region of said inner heel member and the one of said upper and lower second cavities formed in said outer heel member to lock said inner heel member to said outer heel member in one of said first and second positions;

said rod member having an unlocked position with said first pin portion situated outside of said first bore region of said inner heel member and said second pin portion situated within said second bore region of said inner heel member and outside of both said upper and lower second cavities;

biasing means for applying a biasing force on said rod member toward said locking position;

means for grasping said rod member for pulling the same in an axial direction from said locked position to said unlocked position against the biasing force of said biasing means; and a slot formed through said outer heel member wall extending between and opening into said upper and lower first apertures to receive a section of said rod member to permit movement of said inner heel member between said first and second positions when said rod member is said unlocked position wherein said first portion of said elongate rod member exhibits at least one color.

6. A heel assembly for a shoe, comprising:

a first outer heel member having an interior compartment defined in part by a wall;

a second inner heel member at least partially situated in said interior compartment, said second heel member being movable between a first position in said compartment providing said heel assembly with a first height and a second position in said compartment providing said heel assembly with a second height;

a locking mechanism for selectively releasably locking said inner heel member at said first and second positions, including a pair of axially aligned first and second bore regions formed in said inner heel member opening onto diametrically opposed outer surface regions thereof;

upper and lower pairs of axially aligned first and second cavities formed in said outer heel member, each of said first cavities comprising first apertures formed through said wall of said outer heel member situated at a first wall region thereof; and each of said second cavities situated at a second wall region diametrically opposite from a respective one of said first cavities;

an elongate rod member including first and second pin portions at its end regions, said rod member having a locking position in which said first pin portion is situated in said first bore region of said inner heel member and one of said upper and lower first cavities formed in said outer heel member, said second pin portion situated in said second bore region of said inner heel member and the one of said upper and lower second cavities formed in said outer heel member to lock said inner heel member to said outer heel member in one of said first and second positions;

said rod member having an unlocked position with said first pin portion situated outside of said first bore region of said inner heel member and said second pin portion situated within said second bore region of said inner heel member and outside of both said upper and lower second cavities;

biasing means for applying a biasing force on said rod member toward said locking position;

means for grasping said rod member for pulling the same in an axial direction from said locked position to said unlocked position against the biasing force of said biasing means; and a slot formed through said outer heel member wall extending between and opening into said upper and lower first apertures to receive a section of said rod member to permit movement of said inner heel member between said first and second positions when said rod member is said unlocked position wherein said elongate rod member, including first and second pin portions, exhibits more than one color or reflectivity on its surface.

7. A heel assembly for a shoe, comprising:

a first outer heel member having an interior compartment defined in part by a wall;

a second inner heel member at least partially situated in said interior compartment, said second heel member being movable between a first position in said compartment providing said heel assembly with a first height and a second position in said compartment providing said heel assembly with a second height;

a locking mechanism for selectively releasable locking said inner heel member at said first and second positions, including a pair of axially aligned first and second bore regions formed in said inner heel member opening onto diametrically opposed outer surface regions thereof;

upper and lower pairs of axially aligned first and second cavities formed in said outer heel member, each of said first cavities comprising first apertures formed through said wall of said outer heel member situated at a first wall region thereof; and each of said second cavities situated at a second wall region diametrically opposite from a respective one of said first cavities;

an elongate rod member including first and second pin portions at its end regions, said rod member having a locking position in which said first pin portion is situated in said first bore region of said inner heel member and one of said upper and lower first cavities formed in said outer heel member, said second pin portion situated in said second bore region of said inner heel member and the one of said upper and lower second cavities formed in said outer heel member to lock said inner heel member to said outer heel member in one of said first and second positions;

said rod member having an unlocked position with said first pin portion situated outside of said first bore region of said inner heel member and said second pin portion situated within said second bore region of said inner heel member and outside of both said upper and lower second cavities;

biasing means for applying a biasing force on said rod member toward said locking position;

means for grasping said rod member for pulling the same in an axial direction from said locked position to said unlocked position against the biasing force of said biasing means; and a slot formed through said outer heel member wall extending between and opening into said upper and lower first apertures to receive a section of said rod member to permit movement of said inner heel member between said first and second positions when said rod member is said unlocked position wherein at least one of said pin portions of said elongate rod member is of a non-circular cross section.

* * * * *